US007991311B2

(12) United States Patent
Shih et al.

(10) Patent No.: US 7,991,311 B2
(45) Date of Patent: Aug. 2, 2011

(54) IMAGE FORMING APPARATUS AND METHOD FOR CONTROLLING DEVELOPING BIAS VOLTAGE

(75) Inventors: Eric Chun-Wei Shih, Irvine, CA (US); Bruce Cheng-Chih Chen, Hsinchu (TW); Dianne Tan-Feng Tsai, Hsinchu (TW)

(73) Assignee: Aetas Technology Incorporated, Irvine, CA (US)

( * ) Notice: Subject to any disclaimer, the term of this patent is extended or adjusted under 35 U.S.C. 154(b) by 1253 days.

(21) Appl. No.: 11/588,189

(22) Filed: Oct. 26, 2006

(65) Prior Publication Data

US 2008/0101808 A1 May 1, 2008

(51) Int. Cl.
*G03G 15/02* (2006.01)

(52) U.S. Cl. ..... 399/50; 399/53; 399/55; 399/168; 399/222; 399/235; 399/236; 399/285

(58) Field of Classification Search ..... 399/50, 399/53, 55, 168, 222, 235–237, 241, 285, 399/291, 293, 295
See application file for complete search history.

(56) References Cited

U.S. PATENT DOCUMENTS 4,761,672 A * 8/1988 Parker et al. ..... 399/232
4,870,460 A * 9/1989 Harada et al. ..... 399/49
4,974,026 A * 11/1990 Maruyama ..... 399/46
5,179,411 A * 1/1993 Yoshiuchi et al. ..... 399/46
5,970,279 A * 10/1999 Sakaizawa et al. ..... 399/46
5,981,127 A * 11/1999 Nishiguchi et al. ..... 430/111.41
6,125,245 A * 9/2000 Shibuya et al. ..... 399/49
6,128,449 A * 10/2000 Zenba et al. ..... 399/50
6,229,970 B1 * 5/2001 Onimura et al. ..... 399/50
6,463,240 B2 * 10/2002 Onuki et al. ..... 399/234
6,483,998 B2 * 11/2002 Tanaka et al. ..... 399/46
6,686,942 B2 * 2/2004 Okano et al. ..... 347/131
6,839,530 B2 * 1/2005 Takahashi et al. ..... 399/149
6,845,222 B2 * 1/2005 Takai ..... 399/88
7,356,273 B2 * 4/2008 Kimura et al. ..... 399/55
7,796,294 B2 * 9/2010 Sakai et al. ..... 358/1.9
7,826,754 B2 * 11/2010 Kurita et al. ..... 399/26
2002/0018658 A1 * 2/2002 Sakai et al. ..... 399/38
2002/0021912 A1 * 2/2002 Tanaka et al. ..... 399/46
2004/0131370 A1 * 7/2004 Yamauchi ..... 399/24
2005/0008377 A1 * 1/2005 Sakurai et al. ..... 399/25
2005/0175377 A1 * 8/2005 Sakai et al. ..... 399/266
2007/0015071 A1 * 1/2007 Tsukamoto et al. ..... 430/45
2008/0240755 A1 * 10/2008 Shih et al. ..... 399/50

* cited by examiner

*Primary Examiner* — David M Gray
*Assistant Examiner* — Geoffrey T Evans
(74) *Attorney, Agent, or Firm* — Frederic M. Douglas

(57) ABSTRACT

The present invention provides a method and apparatus for forming an image. A controller manages a charger and a developing bias voltage to increase an absolute value of the charging voltage to an image-bearing member and an absolute value of a developing bias voltage to a developer-bearing member to predetermined values in a plurality of steps. The controller controls the developing bias voltage applied to the developer-bearing member; wherein the following relation holds in each of the plurality of steps:

$$|V_D|>|V_i|,$$

where $V_D$ represents a developing bias voltage applied to the developer-bearing member and $V_i$ represents a charged potential of the image-bearing member. This invention is especially useful for mono-component development using DC voltage as a development driving mechanism.

10 Claims, 4 Drawing Sheets

IMAGE FORMING APPARATUS AND METHOD FOR CONTROLLING DEVELOPING BIAS VOLTAGE

BACKGROUND OF THE INVENTION

The present invention relates generally to an electrophotographic image forming apparatus, such as a copying machine, a facsimile machine, or a printer, and, more particularly, to an imaging forming apparatus and a method for controlling a developing bias voltage, a charging voltage, and the difference between the voltages.

Electrophotographic developing systems are generally employed in image-forming apparatuses such as photocopiers, laser beam printers (LBPs), light-emitting diode (LED) printers, and plain paper facsimile machines. The electrophotographic developing system operates to develop electrostatic latent images formed on a photosensitive medium into visible images using developers (such as toner) and transfers the visible images onto a printing medium such as paper. Such developing systems are mainly classified into a one-component developing system using a toner only, and a two-component developer, using a mixture of a carrier and a toner.

Such electrostatic image forming apparatus generally includes an image carrier implemented as a photoconductive drum or a photoconductive belt. A latent image is formed on the image carrier in accordance with image data. A developing device develops the latent image with a toner to thereby produce a corresponding toner image.

When an electrostatic latent image on a photosensitive medium is developed using negative charged toner, a developing bias voltage applied to a developing roller determines an amount of toner to be supplied to the photosensitive medium. For example, as shown in FIG. 1, the photosensitive medium 22 may be charged to a voltage of −750V. After the photosensitive medium 22 is exposed, the image area 24 of the photosensitive medium 22 may retain a voltage, $V_{exp}$, of −60 V. A developing bias voltage applied to a developing roller 20 is generally set to a voltage between charge on the photosensitive medium and image area, such as −450V, (i.e., between −750V and −60V).

The image area 24 may attract toner 26 from the developer roller 20, via; for example, force F1, such that developed toner 28 goes to the image area 24. Force F1 may result from a development potential between the voltage on the developer roller 20 and the voltage on the image area 24. For successful development, force F1 should be great enough to cause toner 26 to traverse a gap G between a developing roller 20 and the photosensitive medium 22. When development is attempted under these conditions, development of the toner 26 is driven by electric fields induced by the voltage difference between the developer roller 20 and the photosensitive medium 22.

When the voltage bias on the developer roller 20 is less than or equal to the voltage on the surface of the photosensitive medium 22, then a repulsive force, such as a surface potential on the surface of photosensitive medium 22, may act to impede or inhibit toner jumping from the developer roller 20 to a non-image area 30 of the photosensitive medium 22.

Additionally, when development is attempted under these conditions, electric fields may be controlled by precision in the size of the development gap. Toner charge distribution may be controlled by electrostatic triboelectric processes. The development gap precision and the toner charge distribution contribute to the enhancement of print quality. Without controlling either the development gap or the toner charge distribution, the printed image often suffers from poor dot formation and excessively thin lines within an image.

As can be seen, there is a need for an improved apparatus and methods for controlling developing bias voltage to solve the problem of degrading print quality, for example, a method that enhances image dot and line formation within an image.

SUMMARY OF THE INVENTION

In one aspect of the present invention, an image forming apparatus comprises a charging element for applying a charging voltage to an image-bearing member (to charge the image-bearing member); an optical writing device to form a latent image on a charged surface of the image-bearing member (which was charged by the charging element); a developer-bearing member to carry toner, having a same polarity as that of the charging voltage, to the image-bearing member and the developer-bearing member applies the toner to the latent image on the image-bearing member to form a toner image when a developing bias voltage is applied thereto; and a control device to control application of the charging voltage by the charging element and application of the developing bias voltage to the developer-bearing member to increase an absolute value of the charging voltage to the image-bearing member and an absolute value of the developing bias voltage to the developer-bearing member to a predetermined value in a plurality of steps, respectively; wherein the control device controls the developing bias voltage applied to the developer-bearing member, wherein the following relation holds in each of the plurality of steps: $|V_D|>|V_i|(|V_D|-|V_i|>0)$ where $V_D$ represents a developing bias voltage applied to the developer-bearing member and $V_i$ represents a charged potential of the image-bearing member.

In another aspect of the present invention, an image forming apparatus comprises a charging element to apply a charging voltage to an image-bearing member to charge the image-bearing member; an optical writing device to form a latent image on a charged surface of the image-bearing member charged by the charging element; a developer-bearing member to carry toner having a same polarity as that of the charging voltage to the image-bearing member and which applies the toner to the latent image on the image-bearing member to form a toner image when a developing bias voltage is applied thereto; and a control device to control application of the charging voltage by the charging element and application of the developing bias voltage to the developer-bearing member to increase an absolute value of the charging voltage to the image-bearing member and an absolute value of the developing bias voltage to the developer-bearing member to a predetermined value in a plurality of steps, respectively; wherein the control device controls the developing bias voltage applied to the developer-bearing member, wherein the following relation holds in each of the plurality of steps: $0\ V \leqq (|V_D|-|V_i|) \leqq 250\ V$, where $V_D$ represents a developing bias voltage applied to the developer-bearing member and $V_i$ represents a charged potential of the image-bearing member.

In a further aspect of the present invention, a method for forming an image comprises rotating a developer-bearing member; rotating an image-bearing member; charging a surface of the image-bearing member to a charged potential of the image-bearing member, to form a charged surface of the image-bearing member; applying a developing bias voltage to the developer-bearing member; forming a latent image on the charged surface of the image-bearing member; supplying toner to the latent image on the image-bearing member to form a toner image; and controlling the application of the developing bias voltage to the developer-bearing member; setting an absolute value of the charging voltage to the image-bearing member and an absolute value of the developing bias voltage to the developer-bearing member to a predetermined value, respectively; wherein the absolute value of the developing bias voltage applied to the developer-bearing member is greater than the absolute value of the charged potential of the image-bearing member.

These and other aspects, objects, features and advantages of the present invention, are specifically set forth in, or will become apparent from, the following detailed description of an exemplary embodiment of the invention when read in conjunction with the accompanying drawings.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Conventional image formation apparatuses and methods set the developer bias at a value between the bias applied to background and image areas on the surface of a photosensitive medium.

The higher the electric field, the more toner is developed. In this invention, the developing roller voltage can be set at the charge potential. Even more advantageous, the developing roller voltage can be larger (more negative) than the charge potential on the photosensitive medium to enhance the toner development.

When the developer bias is less than or equal to the bias applied to the surface of the photoreceptor, then a repulsive force, such as a surface potential, may act to impede or inhibit toner jumping from the developer to the photoreceptor to avoid unwanted background development. Such a condition controls the electrical fields for toner development in direct current (DC) toner jumping development without accounting for a toner adhesion threshold for successful development. The present invention takes advantage of toner adhesion thresholds that allow enhancement of toner development (to form an image) in the image area of an image-bearing member. Controlling the electric fields, according to the present invention, enables successful development without unwanted background development. Prevention of unwanted background development may be accomplished by setting the developer bias to be greater than the charging potential applied to the surface of a photoreceptor but no more than an amount that would trigger visible background development. The maximum amount depends on the toner adhesion threshold. This invention is especially useful for mono-component development using DC voltage as a development driving mechanism.

Figure 2:
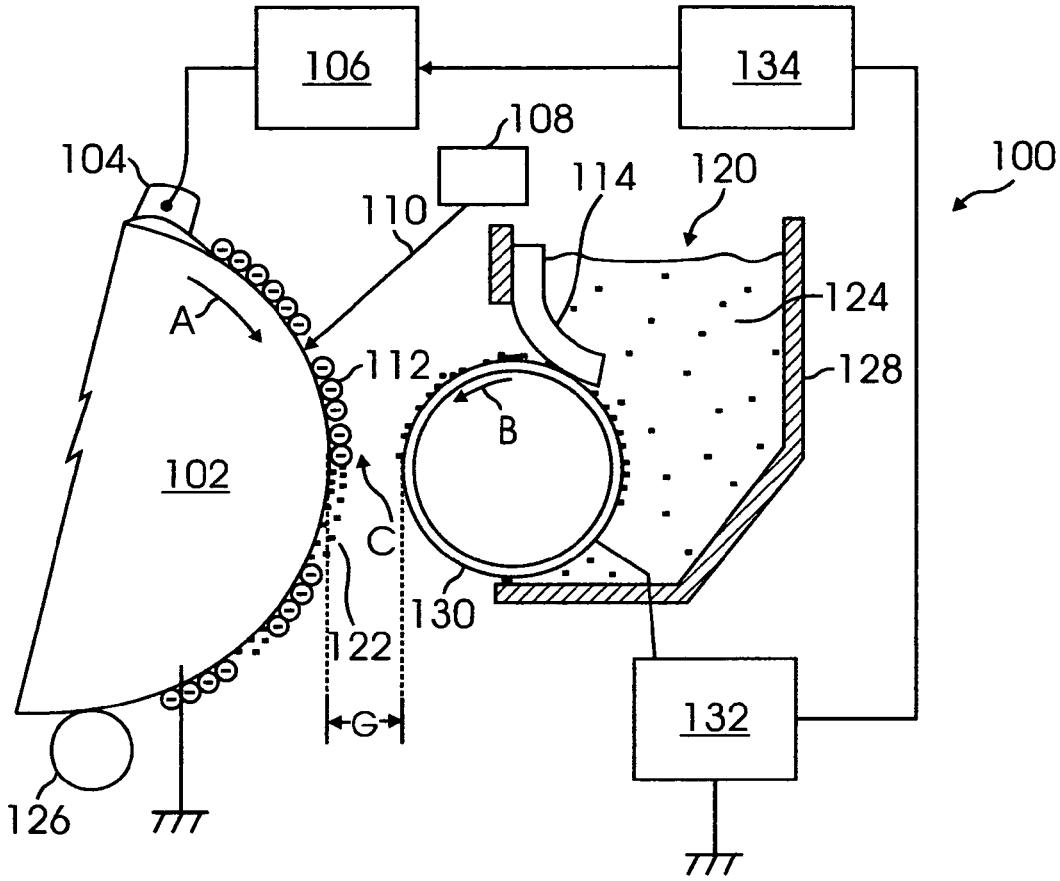
FIG. 2 is a plan view of an image forming apparatus, according to an embodiment of the present invention.

Referring now to the drawings, wherein like reference numerals designate identical or corresponding parts throughout several views, which are not necessarily drawn to scale, and more particularly referring to FIG. 2, the present invention provides an image forming apparatus 100 comprising an image-bearing member 102 (made from, for example, a photoreceptor material). While FIG. 2 shows the image-bearing member 102 as a cylindrical drum, it should be understood that any suitable device may be used in the present invention as an image-bearing member, such as an organic photoconductor belt. A drive section (not shown) may rotationally drive the image-bearing member 102 in a direction indicated by an arrow A. A charging voltage may be applied to the image-bearing member 102 by a charging element 104 supplied with power by a charger power supply 106. The charging element 104 may be of any suitable charging device used in electrophotography. For example the charging element 104 may be a charger as described in U.S. Pat. No. 6,349,024 to Gundlach or U.S. Pat. No. 6,205,309 to Gundlach et al. The charging element 104 may apply a charging voltage to a surface of the image-bearing member 102 to charge the image-bearing member 102 to a uniform charging potential, for example, −650V.

After the image-bearing member 102 is charged by the charging element 104, an optical writing device 108, such as an exposure device, exposes the image-bearing member 102 with energy, such as an exposure light 110 modulated according to image signals, and thereby a latent image 112 is formed on the image-bearing member 102. The latent image 112 may be developed by a developing device 120 to become a toner image 122 by being supplied with toner 124 having the same polarity as that of the charging voltage. The toner 124 may be of any size or equivalent circle diameter, such as about 8 microns (μm). Development with the present invention works exceptionally well when the toner 124 contains negligible amounts of wrong sign toner particles. The toner image 122 on the image-bearing member 102 may be transferred to a transfer medium like a paper sheet (not shown) or an intermediate transfer medium (not shown) by a transfer roller 126 as a transfer device.

The developing device 120 may include a developer container 128 that contains toner 124 (with additives, such as silica or titanium dioxide) and a developer-bearing member 130, which is disposed in the developer container 128 so as to be rotatably supported by the developer container 128. The developer-bearing member 130 may be rotated in a counter-clockwise direction B in a developing operation. The developer-bearing member 130 may rotate at a speed of movement that is higher than or equal to a speed of movement of the image-bearing member 102. The toner 124 may be charged, for example, by friction from a doctor blade element 114 within the developing device 120. For example, the toner 124 may be charged to a negative polarity and the latent image 112 may be charged to a negative polarity in this embodiment. In another embodiment, the toner 124 may be charged to a positive polarity and the latent image 112 may be charged to a negative polarity. It is to be understood that the present invention may be practiced with polarities different from those explicitly stated herein. The latent image 112 on the image-bearing member 102 may be developed with the toner 124 carried on the developer-bearing member 130 to become a toner image 122. The toner 124 may be mixed with a carrier, such that the developer-bearing member 130 carries a carrier mixed with the toner 124. The present invention may be practiced with developer comprising toner, toner mixed with carrier, toner mixed with additives, or any other suitable type of developer.

A voltage (such as, a developing bias voltage) may be applied to the developer-bearing member 130. The voltage applied may be a DC (direct current) voltage bias supplied by a power source, such as a development power supply 132. A control device 134 may be used to control application of the charging voltage by the charging element 104 and/or application of the developing bias voltage to the developer-bearing member 130.

A gap G may be situated between the image-bearing member 102 and the developer-bearing member 130 at a location C where the developer-bearing member 130 and the image-bearing member 102 are closest to each other. The gap G may have a length of from about 100 μm to about 500 μm. More often, the gap G may have a length of from about 120 μm to about 250 μm.

Figure 3:
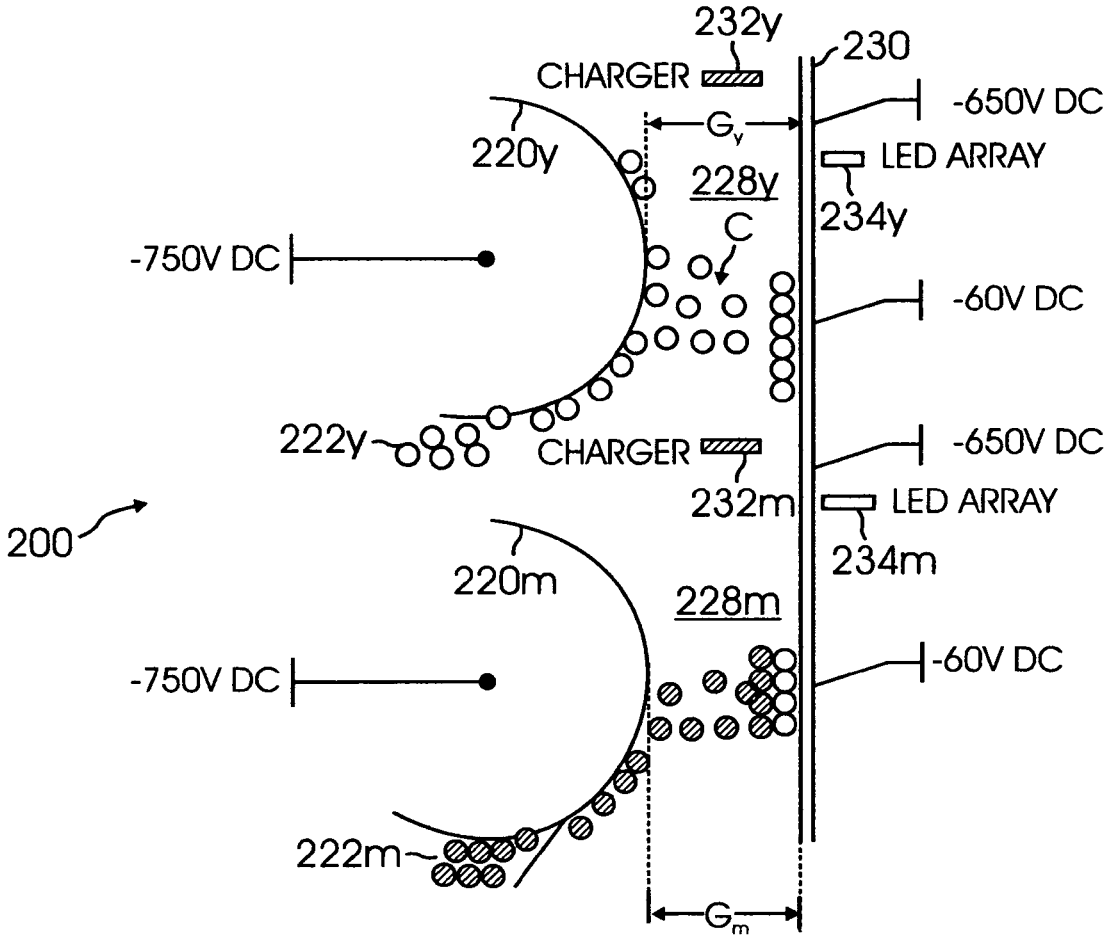
FIG. 3 is a schematic of an image forming apparatus, according to another embodiment of the present invention.

A multi-color image forming apparatus 200 is shown in FIG. 3. A first charging element 232*y* initially may uniformly charge an image-bearing member 230. While FIG. 3 shows the image-bearing member 230 as a belt, it should be understood that any suitable device may be used in the present invention as an image-bearing member, such as an organic photoconductor drum. The image-bearing member 230 may be charged to a charged potential in the range from about −600 V (DC) to about −900 V (DC).

A first optical writing device 234*y*, such as a light-emitting diode (LED) array, laser scanning unit (LSU), or any suitable light source, may expose the image-bearing member 230 by radiating light onto the image-bearing member 230 in a specific pattern corresponding to portions of a desired image that require the inclusion of a particular color, such as the color yellow. The charge on the areas of the image-bearing member 230 that are exposed to the light dissipates to a potential ($V_{exp}$) of about −60 V (DC).

A first developing region 228*y* is adjacent a first developer-bearing member 220*y* where toner 222*y* is directed to latent electrostatic areas along the surface of the image-bearing member 230. After the image-bearing member 230 passes the first developing region 228*y*, the image-bearing member 230 is again uniformly charged to a potential in the range of from about −600 V (DC) to about −900 V (DC) by a second charging element 232*m*. Light is then radiated from a second optical writing device 234*m*, such as an LED array, onto the image-bearing member 230 in a specific pattern corresponding to portions of a desired image that require the inclusion of a particular color, such as the color magenta, including portions that already have yellow toner deposited thereon.

The charge on portions of the image-bearing member 230 that do not already have toner 222*y* deposited thereon dissipates, causing those portions of the image-bearing member 230 to have a potential, $V_{exp}$, of about −60 V (DC). However, the charge on portions of the image-bearing member 230 that already have toner 222*y* deposited thereon tends to dissipate less, causing those portions of the image-bearing member 230 to have a potential in a range of from about −150 V (DC) to about −250 V (DC).

A second developing region 228*m* is adjacent a second developer-bearing member 220*m* where toner 222*m* is directed to latent electrostatic areas along the surface of the image-bearing member 230. After the image-bearing member 230 passes the second developing region 228*m*, the process may be repeated for remaining colors (such as cyan and black).

A gap $G_y$ may be situated between the image-bearing member 230 and the developer-bearing member 220*y* at a location C where the developer-bearing member 220*y* and the image-bearing member 230 are closest to each other. A gap $G_m$ may be situated between the image-bearing member 230 and the developer-bearing member 220*m* at a location C where the developer-bearing member 220*m* and the image-bearing member 230 are closest to each other. The gaps $G_y$, $G_m$ may have a length of from about 100 μm to about 500 μm. More often, the gaps $G_y$, $G_m$ may have a length of from about 120 μm to about 250 μm.

Figure 1:
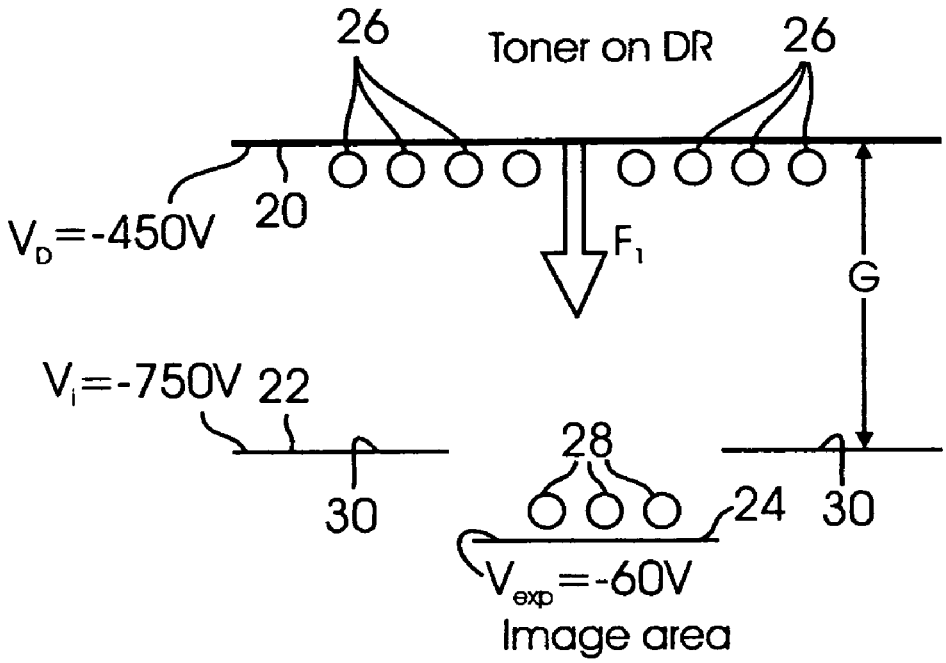
FIG. 1 (Prior Art)
FIG. 1 is a plan view of a prior art method of image formation.
Figure 4:
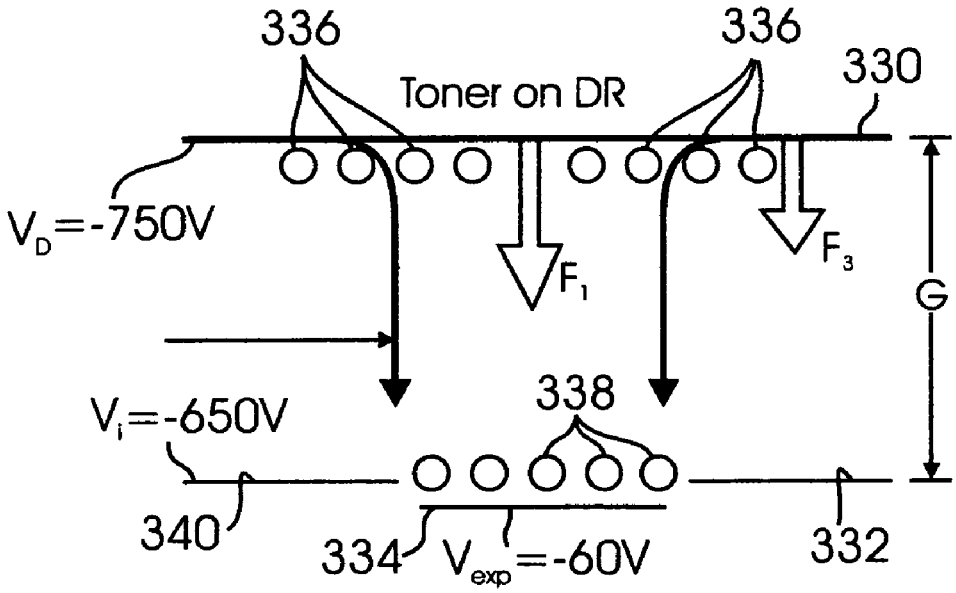
FIG. 4 is a plan view of a method of image formation, according to another embodiment of the present invention.

A method for forming an image is shown in FIG. 4. The method may comprise rotating a developer-bearing member 330, rotating an image-bearing member 332, charging a surface of the image-bearing member 332 to a charged potential (such as $V_i$ at −650 V) of the image-bearing member 332, to form a charged surface of the image-bearing member 332. The charged potential ($V_i$) may be greater than or equal to 500 V and less than or equal to 1000 V ($500 \leqq V_i \leqq 1000$).

The method may continue with applying a developing bias voltage, $V_D$, (for example, $|V_D|$ greater than 650 V, such as $V_D$ at −750 V) to the developer-bearing member 330, by forming a latent image, at an exposure portion 334 on the charged surface of the image-bearing member 332, supplying toner 336 to the latent image on the image-bearing member 332 to form a toner image with developed toner 338, and controlling the application of the developing bias voltage $V_D$ to the developer-bearing member 330, while avoiding development of toner 336 at a non-exposure portion 340. The absolute value of the developing bias voltage ($V_D$) may be greater than or equal to 500 V and less than or equal to 1000 V ($500 \leqq V_D \leqq 1000$).

The absolute value of $V_i$ may be set to values that are about 0 V to about 250 V less than $V_D$ (wherein $V_D$ is between about 500 V to about 1000 V). Output contrast may be enhanced by setting $|V_D|>750$ V, $|V_i|>650$ V, and/or $|V_{exp}|\approx 60$ V so that development voltage ($|V_D|-|V_{exp}|$) is increased to enhance toner development.

Continuing with FIG. 4, the method of forming an image may further comprise setting an absolute value of the charging voltage $V_i$ to the image-bearing member 332 and an absolute value of the developing bias voltage $V_D$ to the developer-bearing member 330 to a predetermined value, respectively wherein the absolute value of the developing bias voltage $V_D$ applied to the developer-bearing member 330 is greater than the absolute value of the charged potential $V_i$ of the image-bearing member 332 ($|V_D|>|V_i|$).

Additionally, the difference between the absolute value of the developing bias voltage $V_D$ and the absolute value of the charged potential $V_i$ may be 0 V or more and 250 V or less ($0\ V \leqq (|V_D|-|V_i|) \leqq 250\ V$). Often, the difference between the absolute value of the developing bias voltage $V_D$ and the absolute value of the charged potential $V_i$ may be 20 V or more and 100 V or less ($20\ V \leqq (|V_D|-|V_i|) \leqq 100V$).

When $|V_D|>|V_i|$, an auxiliary force, such as force F3, would act to boost toner development and/or propel more toner 336 from the developer-bearing member 330 to the exposure portion 334 on the charged surface of the image-bearing member 332. Force F3 may be considered to be an additional electrical field for overcoming adhesion forces between the toner 336 and developer-bearing member 330.

Figure 5:
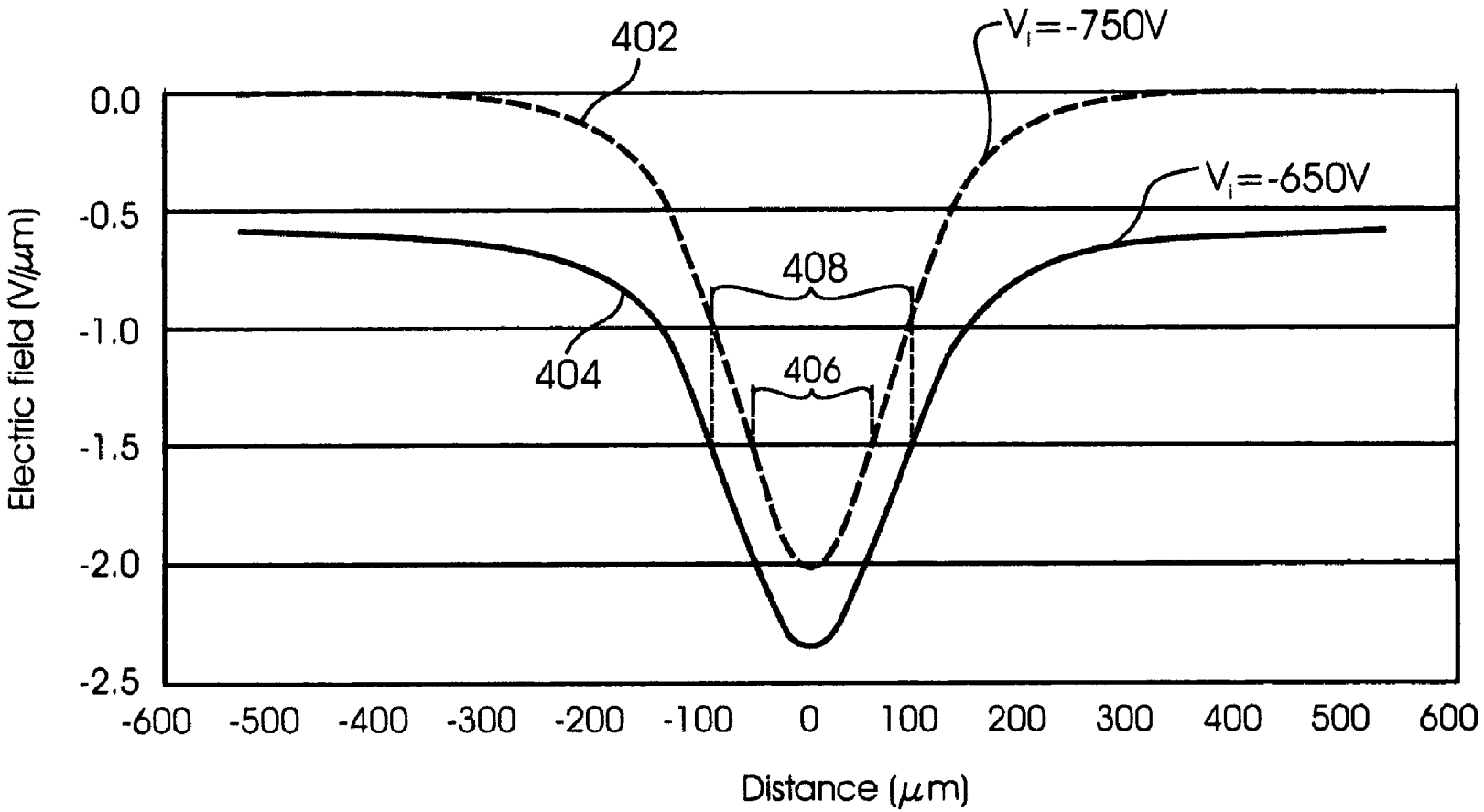
FIG. 5 is a graph of electric field versus distance for a simulation of various methods of image formation.

FIG. 5 illustrates the electric field results of a numerical simulation of the conditions described above in FIG. 4. Assuming a two-pixel line development and a toner adhesion threshold of about 1.5 V/microns (μm), an electric field distribution along the developer-bearing member surface is presented as a function of development width in microns (μm). Plot 402 describes the simulated behavior of the method in FIG. 4 when $V_i$=−750 V. Plot 404 describes the simulated behavior of the method in FIG. 4 when $V_i$=−650 V. As can be seen in FIG. 5, a development line width 408 when, for example, $V_i$=−650 V is expected to be more than a development line width 406 when $V_i$=−750 V.

Experiments have shown that as $(|V_D|-|V_i|)$ increases, development is enhanced for the formation of fine lines and the formation of dots, using the present invention. $V_i$ was varied while $V_D$ was maintained constant. Both developed dot size and line width increased as $(|V_D|-|V_i|)$ increased. Further experiments have shown that as $(|V_D|-|V_{exp}|)$ increases, the operation window of development increases.

It should be understood, of course, that the foregoing relates to exemplary embodiments of the invention and that modifications may be made without departing from the spirit and scope of the invention as set forth in the following claims.

We claim:

1. An image forming apparatus, comprising:

a charging element to apply a charging voltage to an image-bearing member to charge the image-bearing member;

an optical writing device to form a latent image on a charged surface of the image-bearing member charged by the charging element;

a developer-bearing member to carry toner having a same polarity as that of the charging voltage to the image-bearing member and which applies the toner to the latent image on the image-bearing member to form a toner image when a developing bias voltage is applied thereto; and a control device to control application of the charging voltage by the charging element and application of the developing bias voltage to the developer-bearing member to increase an absolute value of the charging voltage to the image-bearing member and an absolute value of the developing bias voltage to the developer-bearing member to a predetermined value in a plurality of steps, respectively;

wherein the control device controls the developing bias voltage applied to the developer-bearing member, wherein the following relation holds in each of the plurality of steps:

$$20\text{ V} \leqq (|V_D|-|V_i|) \leqq 49\text{ V},$$

wherein $V_D$ represents a developing bias voltage applied to the developer-bearing member and $V_I$ represents a charged potential of the image-bearing member, wherein $|V_D|>750$ V and $|V_I|>650$ V.

2. The image forming apparatus of claim 1, wherein a development line width is greater than or equal to 200 μm.

3. The image forming apparatus of claim 1, wherein the latent image has an exposure portion and a non-exposure portion.

4. The image forming apparatus of claim 1, wherein the developer-bearing member rotates at a speed of movement that is higher than or equal to a speed of movement of the image-bearing member.

5. The image forming apparatus of claim 1, wherein $|V_D|$ is greater than 750 V and less than or equal to 1000 V.

6. The image forming apparatus of claim 1, further comprising a gap situated where the developer-bearing member and the image-bearing member are closest to each other.

7. The image forming apparatus of claim 6, wherein the gap has length of from about 100 μm to about 500 μm.

8. A method for forming an image, comprising:

rotating a developer-bearing member;

rotating an image-bearing member;

charging a surface of the image-bearing member to a charged potential of the image-bearing member, to form a charged surface of the image-bearing member;

applying a developing bias voltage to the developer-bearing member;

forming a latent image on the charged surface of the image-bearing member;

supplying toner to the latent image on the image-bearing member to form a toner image; and controlling the application of the developing bias voltage to the developer-bearing member;

setting an absolute value of the charged potential of the image-bearing member and an absolute value of the developing bias voltage to the developer-bearing member to a predetermined value, respectively;

wherein the absolute value of the developing bias voltage applied to the developer-bearing member is greater than the absolute value of the charged potential of the image-bearing member; and a difference between the absolute value of the developing bias voltage applied to the developer-bearing member and the absolute value of the charged potential of the image-bearing member is between 20 V and 49 V, wherein the absolute value of the developing bias voltage applied to the developer-bearing member is greater than 750 V and the absolute value of the charged potential of the image-bearing member is greater than 650 V.

9. The method for forming an image according to claim 8, wherein a development line width is greater than or equal to 200 μm.

10. The method for forming an image according to claim 8, wherein the latent image has an exposure portion and a non-exposure portion.

* * * * *